US012403522B2

(12) United States Patent
Migliaccio

(10) Patent No.: US 12,403,522 B2
(45) Date of Patent: Sep. 2, 2025

(54) TOOLS FOR FOLDING PIECES OF SHEET METAL AND METHODS OF MANUFACTURE AND USE THEREOF

(71) Applicant: DiversiTech Corporation, Duluth, GA (US)

(72) Inventor: Craig Migliaccio, Cape May Court House, NJ (US)

(73) Assignee: DiversiTech Corporation, Duluth, GA (US)

( * ) Notice: Subject to any disclaimer, the term of this patent is extended or adjusted under 35 U.S.C. 154(b) by 427 days.

(21) Appl. No.: 18/076,767

(22) Filed: Dec. 7, 2022

(65) Prior Publication Data

US 2023/0173569 A1 Jun. 8, 2023

Related U.S. Application Data

(60) Provisional application No. 63/286,901, filed on Dec. 7, 2021.

(51) Int. Cl.
*B21D 39/02* (2006.01)
*B21D 5/16* (2006.01)

(52) U.S. Cl.
CPC ..... *B21D 39/025* (2013.01); *B21D 5/16* (2013.01)

(58) Field of Classification Search
CPC ..... B21D 39/02; B21D 39/021; B21D 19/00
See application file for complete search history.

(56) References Cited

U.S. PATENT DOCUMENTS

| | | | |
|---|---|---|---|
| 1,448,194 | A | 3/1923 | Cassidy |
| 2,076,228 | A | 4/1937 | Dressing |
| 2,159,784 | A | 5/1939 | Demmin |
| 2,233,937 | A | 3/1941 | Hexdall |
| 2,265,234 | A | 12/1941 | Jensen |
| 2,283,258 | A | 5/1942 | Jensen |
| 2,567,789 | A | 9/1951 | Sawyer |
| 2,581,715 | A | 1/1952 | Royer |
| 2,586,337 | A | 2/1952 | Hughes |
| 2,610,398 | A | 9/1952 | Royer |
| 2,800,069 | A | 7/1957 | Smith |
| 2,912,013 | A | 11/1959 | Freyholdt |

(Continued)

FOREIGN PATENT DOCUMENTS

| | | |
|---|---|---|
| AU | 691135 B2 | 5/1998 |
| AU | 2004200415 A1 | 8/2004 |

(Continued)

*Primary Examiner* — Seahee Hong
(74) *Attorney, Agent, or Firm* — Dentons US LLP

(57) ABSTRACT

This disclosure enables various tools for folding pieces of sheet metal and methods of manufacture and use thereof. For example, some of such tools include a first pair of jaws spaced apart from each other at a first distance, a second pair of jaws spaced apart from each other at a second distance greater than the first distance, and a body spanning between the first pair of jaws and the second pair of jaws. By having the second distance being greater than the first distance, a user may use the body to form a primary bend (e.g., a hem) on a piece of sheet metal via bending the piece of sheet metal via the first pair of jaws, or vice versa, and then a secondary bend of the primary bend to form a desired shape (e.g., an S-shape) on the piece of sheet metal via the second pair of jaws, or vice versa.

25 Claims, 6 Drawing Sheets

(56) References Cited

U.S. PATENT DOCUMENTS

| | | | | | |
|---|---|---|---|---|---|
| 2,919,613 | A * | 1/1960 | Crement | B21D 39/025 81/26 |
| 2,919,912 | A | 1/1960 | Brinkhaus | |
| 3,130,520 | A | 4/1964 | Newman, Jr. | |
| 3,170,544 | A | 2/1965 | Kinkead | |
| 3,225,432 | A | 12/1965 | Widman | |
| 3,325,952 | A | 6/1967 | Trachtenberg | |
| 3,701,194 | A | 10/1972 | Widman | |
| 4,034,595 | A * | 7/1977 | Smith | B21D 39/025 81/488 |
| 4,516,370 | A | 5/1985 | Halmos | |
| 4,614,102 | A | 9/1986 | Kaar | |
| 4,934,174 | A * | 6/1990 | Gronlund | B21D 1/06 72/705 |
| 5,083,380 | A | 1/1992 | Robertson | |
| 5,095,735 | A | 3/1992 | Schneider, Jr. | |
| 5,189,784 | A | 3/1993 | Welty | |
| 5,243,750 | A | 9/1993 | Welty | |
| 5,259,363 | A | 11/1993 | Peacock | |
| 5,353,616 | A | 10/1994 | Fischer | |
| 5,394,729 | A * | 3/1995 | Eisenhower, Jr. | B21D 19/00 72/450 |
| 5,775,162 | A | 7/1998 | Ward | |
| 5,782,700 | A | 7/1998 | Haas | |
| 6,089,075 | A * | 7/2000 | Bramblett | B21D 1/10 72/705 |
| 6,981,398 | B2 | 1/2006 | Toben | |
| 7,681,297 | B2 | 3/2010 | Toben | |
| 8,104,127 | B1 * | 1/2012 | Scanlan | B21D 39/02 81/3.55 |
| 9,375,776 | B2 | 6/2016 | Baker | |
| 9,459,019 | B2 | 10/2016 | Runyan | |
| D814,256 | S * | 4/2018 | Libreiro | D8/14 |
| 10,160,027 | B2 | 12/2018 | Baker | |
| 10,882,096 | B2 | 1/2021 | Holmstock | |
| 10,976,070 | B1 | 4/2021 | Albers | |
| 10,976,071 | B2 | 4/2021 | Foster | |
| 11,919,282 | B2 * | 3/2024 | Dallan | B21D 39/021 |
| 2008/0134495 | A1 * | 6/2008 | Joung | B21D 39/02 29/623.2 |
| 2017/0100759 | A1 * | 4/2017 | Libreiro | B21D 39/021 |
| 2019/0344320 | A1 | 11/2019 | Bowen | |

FOREIGN PATENT DOCUMENTS

| | | | |
|---|---|---|---|
| AU | 2014240278 | B2 | 2/2016 |
| CA | 714245 | A | 7/1965 |
| CA | 1141929 | A | 3/1983 |
| CA | 2060032 | C | 7/1998 |
| CA | 3027411 | A1 | 7/2019 |
| DK | 202200035 | U3 | 6/2022 |
| EP | 0053456 | B1 | 3/1984 |
| EP | 0967045 | B1 | 1/2003 |
| GB | 2153470 | B | 9/1987 |
| JP | H1029023 | A | 2/1998 |
| JP | 4465345 | B2 | 5/2010 |
| JP | 2012163288 | A | 8/2012 |
| JP | 5020500 | B2 | 9/2012 |
| JP | 2020085320 | A | 6/2020 |
| KR | 20020091236 | A | 12/2002 |
| KR | 20190070947 | A | 6/2019 |
| WO | WO9513507 | A1 | 5/1995 |

* cited by examiner

TOOLS FOR FOLDING PIECES OF SHEET METAL AND METHODS OF MANUFACTURE AND USE THEREOF

CROSS-REFERENCE TO RELATED PATENT APPLICATION

This patent application claims a benefit of priority to U.S. Provisional Patent Application 63/286,901 filed on 7 Dec. 2021, which is incorporated by reference herein for all purposes.

TECHNICAL FIELD

This disclosure relates to tools for folding pieces of sheet metal. More particularly, this disclosure relates to tools for folding pieces of sheet metal to be used, for example, in heating, ventilation, and air conditioning (HVAC) applications.

BACKGROUND

Some pieces of sheet metal can be folded at manufacturing facilities to create various standardized three-dimensional shapes. However, in many cases, those pieces need to be folded or modified infield or onsite to create customized segments for specific applications during installation or repair. For example, those pieces of sheet metal may need to be folded onsite to create plenum end caps or odd-sized segments for ducts used in HVAC systems to conduct conditioned air. Conventional techniques for folding such pieces of sheet metal are cumbersome, time-consuming, laborious, and require expertise with multiple tools (e.g., a standard folding tool and a handbrake), which are limited in functionality, thereby resulting in folds that may be misaligned or have poor quality.

SUMMARY

This disclosure enables various tools for folding pieces of sheet metal and methods of manufacture and use thereof. For example, some of such tools include a first pair of jaws spaced apart from each other at a first distance, a second pair of jaws spaced apart from each other at a second distance greater than the first distance, and a body spanning between the first pair of jaws and the second pair of jaws. By having the second distance being greater than the first distance, a user may use the body to form a primary bend (e.g., a hem) on a piece of sheet metal via bending the piece of sheet metal via the first pair of jaws, or vice versa, and then a secondary bend of the primary bend to form a desired shape (e.g., an S-shape) on the piece of sheet metal via the second pair of jaws, or vice versa. This structure and modality of operation may be used infield or onsite to create customized segments of certain pieces of sheet metal for specific applications during installation or repair. For example, those pieces of sheet metal may be folded onsite to create plenum end caps or odd-sized segments for ducts used in HVAC systems to conduct conditioned air in a manner that is not cumbersome, not time-consuming, not laborious, or does not require expertise with multiple tools (e.g., a standard folding tool and a handbrake), thereby resulting in folds that are not misaligned or not having poor quality.

In an embodiment, a device comprising: a first pair of jaws spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa; a second pair of jaws spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa; and a body spanning between the first pair of jaws and the second pair of jaws.

In an embodiment, a method comprising: causing a user to access a tool including a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws; causing the user insert the edge portion into the first pair of jaws to form the hem on the piece of sheet metal via the edge portion being bent as the first pair of jaws is moved relative to the piece of sheet metal or vice versa; and causing the user to insert the hem into the second pair of jaws to bend the piece of sheet metal containing the hem as the second pair of jaws is moved relative to the piece of sheet metal or vice versa.

In an embodiment, a method comprising: supplying a tool to a user, wherein the tool includes a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws; and instructing the user to: insert the edge portion into the first pair of jaws to form the hem on the piece of sheet metal via the edge portion being bent as the first pair of jaws is moved relative to the piece of sheet metal or vice versa; and insert the hem into the second pair of jaws to bend the piece of sheet metal containing the hem as the second pair of jaws is moved relative to the piece of sheet metal or vice versa.

In an embodiment, a method comprising: manufacturing a tool including a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws.

BRIEF DESCRIPTION OF DRAWINGS

Various embodiments of tools for folding pieces of sheet metal are described herein with reference to the drawings, wherein.

Figure 1A:
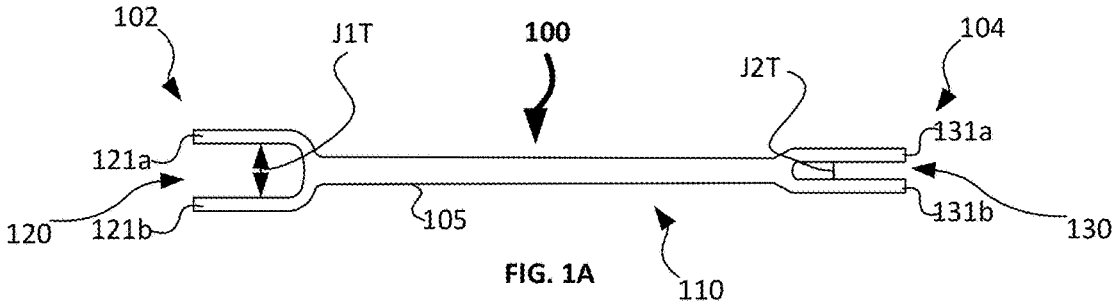
FIGS. 1A-B are schematic cross-sectional and top views of an embodiment of a tool for folding a piece of sheet metal.

Various embodiments of this disclosure will now be described with reference to the drawings. These drawings depict some embodiments of this disclosure and are therefore not to be considered limiting of its scope.

DETAILED DESCRIPTION

As explained above, this disclosure enables various tools for folding pieces of sheet metal and methods of manufacture and use thereof. For example, some of such tools include a first pair of jaws spaced apart from each other at a first distance, a second pair of jaws spaced apart from each other at a second distance greater than the first distance, and a body spanning between the first pair of jaws and the second pair of jaws. By having the second distance being greater than the first distance, a user may use the body to form a primary bend (e.g., a hem) on a piece of sheet metal via bending the piece of sheet metal via the first pair of jaws, or vice versa, and then a secondary bend of the primary bend to form a desired shape (e.g., an S-shape) on the piece of sheet metal via the second pair of jaws, or vice versa. This structure and modality of operation may be used infield or onsite to create customized segments of certain pieces of sheet metal for specific applications during installation or repair. For example, those pieces of sheet metal may be folded onsite to create plenum end caps or odd-sized segments for ducts used in HVAC systems to conduct conditioned air in a manner that is not cumbersome, not time-consuming, not laborious, or does not require expertise with multiple tools (e.g., a standard folding tool and a hand-brake), thereby resulting in folds that are not misaligned or not having poor quality.

This disclosure is now described more fully with reference to the drawings, in which some embodiments of this disclosure are shown. This disclosure may, however, be embodied in many different forms and should not be construed as necessarily being limited to various embodiments disclosed herein. Rather, these embodiments are provided so that this disclosure is thorough and complete, and fully conveys various concepts of this disclosure to skilled artisans. Note that like numbers or similar numbering schemes can refer to like or similar elements throughout.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

As used herein, a term "or" is intended to mean an inclusive "or" rather than an exclusive "or." That is, unless specified otherwise, or clear from context, "X employs A or B" is intended to mean any of natural inclusive permutations. That is, if X employs A; X employs B; or X employs both A and B, then "X employs A or B" is satisfied under any of the foregoing instances. For example, X includes A or B can mean X can include A, X can include B, and X can include A and B, unless specified otherwise or clear from context.

As used herein, each of singular terms "a," "an," and "the" is intended to include a plural form (e.g., two, three, four, five, six, seven, eight, nine, ten, tens, hundreds, thousands, millions) as well, including intermediate whole or decimal forms (e.g., 0.0, 0.00, 0.000), unless context clearly indicates otherwise. Likewise, each of singular terms "a," "an," and "the" shall mean "one or more," even though a phrase "one or more" may also be used herein.

As used herein, each of terms "comprises," "includes," or "comprising," "including" specify a presence of stated features, integers, steps, operations, elements, or components, but do not preclude a presence or addition of one or more other features, integers, steps, operations, elements, components, or groups thereof.

As used herein, when this disclosure states herein that something is "based on" something else, then such statement refers to a basis which may be based on one or more other things as well. In other words, unless expressly indicated otherwise, as used herein "based on" inclusively means "based at least in part on" or "based at least partially on."

As used herein, terms, such as "then," "next," or other similar forms are not intended to limit an order of steps. Rather, these terms are simply used to guide a reader through this disclosure. Although process flow diagrams may describe some operations as a sequential process, many of those operations can be performed in parallel or concurrently. In addition, the order of operations may be rearranged.

As used herein, a term "response" or "responsive" are intended to include a machine-sourced action or inaction, such as an input (e.g., local, remote), or a user-sourced action or inaction, such as an input (e.g., via user input device).

As used herein, a term "about" or "substantially" refers to a +/−10% variation from a nominal value/term.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

Although various terms, such as first, second, third, and so forth can be used herein to describe various elements, components, regions, layers, or sections, note that these elements, components, regions, layers, or sections should not necessarily be limited by such terms. Rather, these terms are used to distinguish one element, component, region, layer, or section from another element, component, region, layer, or section. As such, a first element, component, region, layer, or section discussed below could be termed a second element, component, region, layer, or section, without departing from this disclosure.

Unless otherwise defined, all terms (including technical and scientific terms) used herein have a same meaning as commonly understood by skilled artisans to which this disclosure belongs. These terms, such as those defined in commonly used dictionaries, should be interpreted as having a meaning that is consistent with their meaning in context of relevant art and should not be interpreted in an idealized or overly formal sense, unless expressly so defined herein.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Features or functionality described with respect to certain embodiments may be combined and sub-combined in or with various other embodiments. Also, different aspects, components, or elements of embodiments, as disclosed herein, may be combined and sub-combined in a similar manner as well. Further, some embodiments, whether individually or collectively, may be components of a larger system, wherein other procedures may take precedence over or otherwise modify their application. Additionally, a number of steps may be required before, after, or concurrently with embodiments, as disclosed herein. Note that any or all methods or processes, as disclosed herein, can be at least partially performed via at least one entity or actor in any manner.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of a item or term, such as BB, AAA, AB, BBC, AAABCCCC, CBBAAA, CABABB, and so forth. Skilled artisans understand that typically there is no limit on a number of items or terms in any combination, unless otherwise apparent from the context.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or any other types of manufacturing. For example, some manufacturing processes include three dimensional (3D) printing, laser cutting, computer numerical control routing, milling, pressing, stamping, vacuum forming, hydroforming, injection molding, lithography, and so forth.

Hereby, all issued patents, published patent applications, and non-patent publications that are mentioned or referred to in this disclosure are herein incorporated by reference in their entirety for all purposes, to a same extent as if each individual issued patent, published patent application, or non-patent publication were specifically and individually indicated to be incorporated by reference. To be even more clear, all incorporations by reference specifically include those incorporated publications as if those specific publications are copied and pasted herein, as if originally included in this disclosure for all purposes of this disclosure. Therefore, any reference to something being disclosed herein includes all subject matter incorporated by reference, as explained above. However, if any disclosures are incorporated herein by reference and such disclosures conflict in part or in whole with this disclosure, then to an extent of the conflict or broader disclosure or broader definition of terms, this disclosure controls. If such disclosures conflict in part or in whole with one another, then to an extent of conflict, the later-dated disclosure controls.

As used herein, terms "trailing" and "leading" are to be taken as relative to a user of a tool for folding a piece of sheet metal. "Trailing" is to be understood as relatively close to the user and "leading" is to be understood as relatively farther away from the user.

Figure 1B:
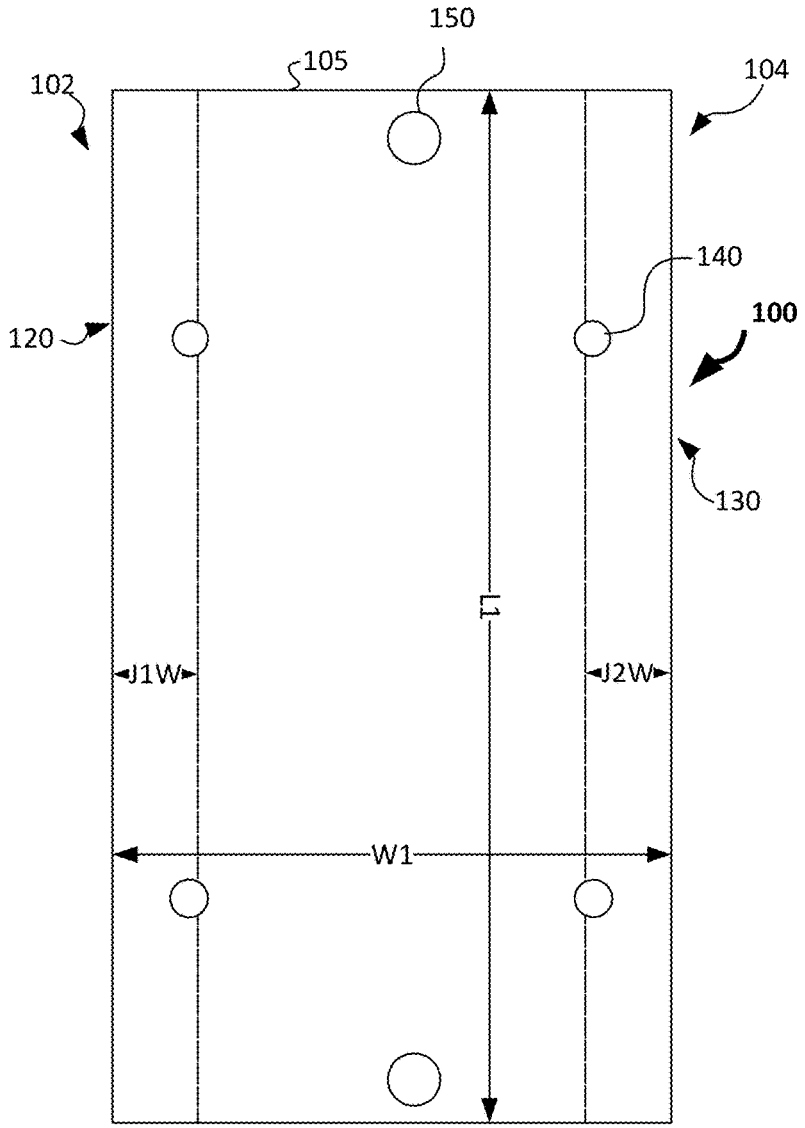

FIGS. 1A-B illustrate one example of a tool 100 (e.g., a board) configured to be used for folding a piece of sheet metal. In particular, the tool 100 includes a body 105, a first end portion 102, and a second end portion 104. The body 105 spans between the first end portion 102 and the second end portion 104, thereby forming a pair of first jaws 120 (mouth) located at the first end portion 102, a pair of second jaws 130 (mouth) located at the second end portion 104, and a central portion 110 spanning (or bridging) between the first pair of jaws 120 and the second pair of jaws 130. The central portion 110 is rectilinear, but can be arcuate, sinusoidal, or another suitable shape.

Each of the first pair of jaws 120 and the second pair of jaws 130 respectfully includes two opposing elongated members cantileveredly extending from the body 105, while being spaced apart from each other at a distance, such that the first pair of jaws 120 is defined by an upper portion 121*a* and a lower portion 121*b*, and the second pair of jaws 130 is defined by an upper portion 131*a* and a lower portion 131*b*.

The upper portion 121*a* and the lower portion 121*b* have an identical longitudinal length J1W (width) measured from the body 105, although this is not required. The upper portion 131*a* and the lower portion 131*b* have an identical longitudinal length J2W (width) measured from the body 105, although this is not required. The upper portion 121*a* and the upper portion 131*a* may have an identical longitudinal length measured from the body 105 in opposing directions from the body 105 (J1W=J2W), although this is not required. The lower portion 121*b* and the lower portion 131*b* may have an identical longitudinal length measured from the body 105 in opposing directions from the body 105 (J1W=J2W), although this is not required.

The distance between the upper portion 121*a* and the lower portion 121*b* is labeled as J1T (thickness) and the distance between the upper portion 131*a* and the lower portion 131*b* is labeled as J2T (thickness), where the J1T is not equal to the J2T. For example, the J1T is greater than J2T. The tool 100 may have a width W1 measured end-to-end between the first pair of jaws 120 and the second pair of jaws 130. The tool 100 may have a length L1 measured end-to-end on the body 105 traversing the width W1. For example, the tool 100 may include a length L1 of between 6" and 36". In at least some examples, the tool 100 may have a length L1 of 12", 18" or 24". For example, the tool 100 may also have a width W1 of between 2" and 8". In at least some examples, the tool 100 has a width W1 of 3.25". Each of the first pair of jaws 120 and the second pair of jaws 130 may have certain dimensions configured and arranged to allow folding of a piece of sheet metal for specific applications. In some examples, the first pair of jaws 120 has a width J1W of ½" and a thickness J1T of ¼", and the second pair of jaws 130 has a width J2W of ½" and a thickness J2T of 1/16". In at least some examples, the first pair of jaws 120 has a thickness J1T that is ⅛", 3/16", ¼" or 7/16". In at least some examples, the second pair of jaws 130 has a thickness J2T that is 1/32", 1/16", or 3/32". The second pair of jaws 130 may be used to fold a piece of sheet metal as a hem, as further explained below.

The first pair of jaws 120, the body 105, and the second pair of jaws 130 form a polygonal shape (e.g., a rectangle, a square), although this is not required. For example, the upper portion 121*a* and the lower portion 121*b* may be shaped as flat or planar sheets opposing each other in the first pair of jaws 120. Likewise, the upper portion 131*a* and the lower portion 131*b* may be shaped as flat or planar sheets opposing each other in the second pair of jaws 130. Similarly, the body 105 may be shaped as a flat or planar piece spanning between the first pair of jaws 120 and the second pair of jaws 130.

The tool 100 may have a set of holes or apertures 140, where such holes or apertures 140 are positioned at the body 105 or a set of areas from which the upper portion 121*a* and the lower portion 121*b* extend from the body 105 or the upper portion 131*a* and the lower portion 131*b* extend from the body 105. The holes or apertures 140 provides visual access into the first pair of jaws 120 or the second pair of jaws 130, as further explained below.

The holes or apertures 140 may be arranged with two holes or apertures 140 along each major side of the tool 100, i.e., two holes or apertures 140 in proximity of the first pair of jaws 120 and two holes or apertures 140 in proximity the second pair of jaws 130, whether laterally opposing each other or not, although less than two or more than holes or apertures 140 extending along per major side of the tool 100 is possible. In this example, the holes or apertures 140 are disposed adjacent the ends of the jaw widths J1W, J2W so that a piece of sheet metal respectively inserted by the user into the first pair of jaws 120 or the second pair of jaws 130 can be respectively seen by the user within the first pair of jaws 120 or the second pair of jaws 130, indicating that the piece of sheet metal is contacting the body 105 within the first pair of jaws 120 or the second pair of jaws 130 or is ready for bending, as further explained below. Though the holes or apertures 140 are shown as circles, this is not required and the holes or apertures 140 may be triangular, square or other any other suitable shape. Additionally, though two holes or apertures 140 are shown per each major side of the tool 100, this is not required and a single aperture may be disposed per each major side of the tool 100, or that three, four or more holes or apertures 140 may be disposed per each major side of the tool 100, and separated from one another by a predetermined gap or be randomly or unequally spaced relative to the opposing holes or apertures 140. Alternatively, the tool 100 may be formed with no holes or apertures 140 at all, or with holes or apertures 140 adjacent to only one of the first pair jaws 120 or the second pair of jaws 130.

The tool 100 may have a set of holes or apertures 150. For example, the body 105 may have the holes or apertures 150 positioned between the first pair of jaws 120 and the second pair of jaws 130. The holes or apertures 140 may be positioned between the holes or apertures 150. The holes or apertures 150 may be positioned towards the minor sides of the tool 100 for manufacturing purposes or for hanging the tool 100 onto a post, a hook, a nail, a screw, or another suitable device, although such positioning is not required and can vary.

The tool 100 may be formed to be unitary as a single monolithic piece structured as shown in FIGS. 1A-1B, such via additive manufacturing, subtractive manufacturing, molding, 3d printing, chiseling, routing, or other suitable techniques, whether using metals, alloys, plastics, wood, or other materials sufficiently rigid for folding pieces of sheet metal, as disclosed herein. For example, the body 105 may be monolithic with the first pair of jaws 120 or the second pair of jaws 130. Likewise, for example, the body 105 itself may be monolithic.

The tool 100 may be formed to be an assembly (e.g., joining, attaching, connecting) two separate plates (or flat or planar portions) of equal (or unequal) size or shape such that these plates contact each other or rest on each other. In such cases, the end portions of one of those plates that oppose each other may be structured to include the upper portion 121*a* and the upper portion 131*a*, and the end portions of another of those plates that oppose each other may be structured to include the lower portion 121*b* and the lower portion 131*b*, with terms "upper" or "lower" being used for relative consistency in context of FIG. 1A. In some examples, two separate rectangular (or square or polygon or another suitable shape) flat or planar plates (or flat or planar portions) are cut, accessed, or provided, with each of the plates (or flat or planar portions) being formed of a suitable metal, alloy, or other suitable material (e.g., 1/16" cr-v or other strong steel composite). The holes or apertures 140 or the holes or apertures 150 may be punched into one of, or each of the two plates (or flat or planar portions) so that the user can see into one or both of the first pair of jaws 120 and the second pair of jaws 130, or the tool 100 may be hanged by the holes or the apertures 150, as explained above. Note that burs from this punching process may be removed and smoothed. The two plates may be assembled or joined (e.g., fastened, screwed, bolted, magnetized, adhered, welded, interlocked, mated) or pressed into shape to form the first pair of jaws 120 and the second pair of jaws 130 of suitable thicknesses (or mouths that are open) that are not identical to each other (J1T is greater than J2T). Next, the two plates (or flat or planar portions) may be lined up or aligned on top of each other, using the holes or apertures 140 or the holes or apertures 150 to overlap or extend over each other. The two plates may then be welded together, cleaned and then powder coated. A logo or a marking visible to the user may be disposed on one or both plates. Note that the two plates can be joined to each via a form of assembly other than welding. For example, the two plates may be fastened, screwed, bolted, magnetized, adhered, welded, interlocked, mated, or otherwise suitably joined to or assembled with each other between the upper portion 121*a* and the upper portion 131*a*, and the lower portion 121*a* and and the lower portion 131*b*, where after such joining or assembly the first pair of jaws 120 and the second pair of jaws 130 is formed thereby, with the body 105 having two plates (or flat or planar portions) between the first pair of jaws 120 and the second pair of jaws 130.

Figure 2:
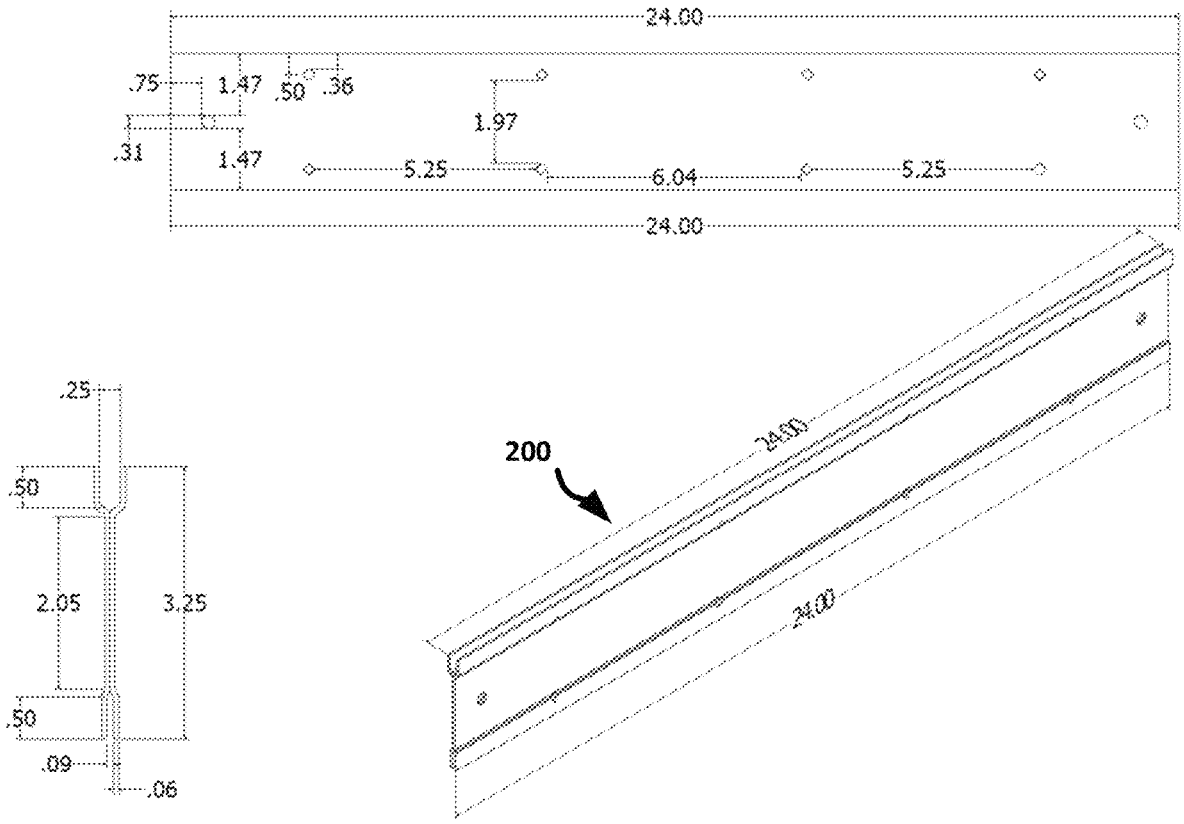
FIG. 2 shows schematic top, perspective and cross-sectional views of an embodiment of a tool for folding a piece of sheet metal.
Figure 3A:
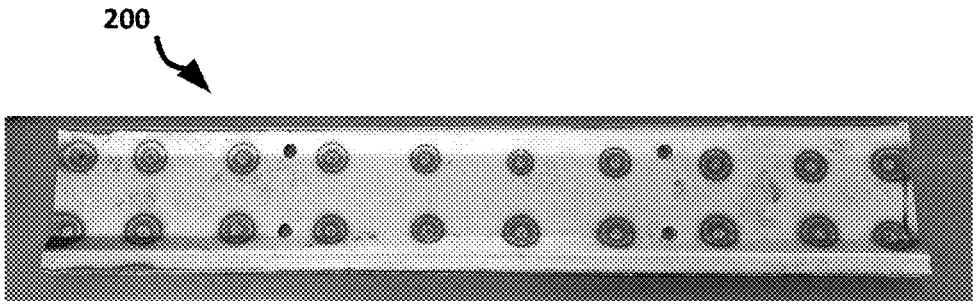
FIGS. 3A-B are photographs showing an example of a tool for folding a piece of sheet metal.
Figure 3B:
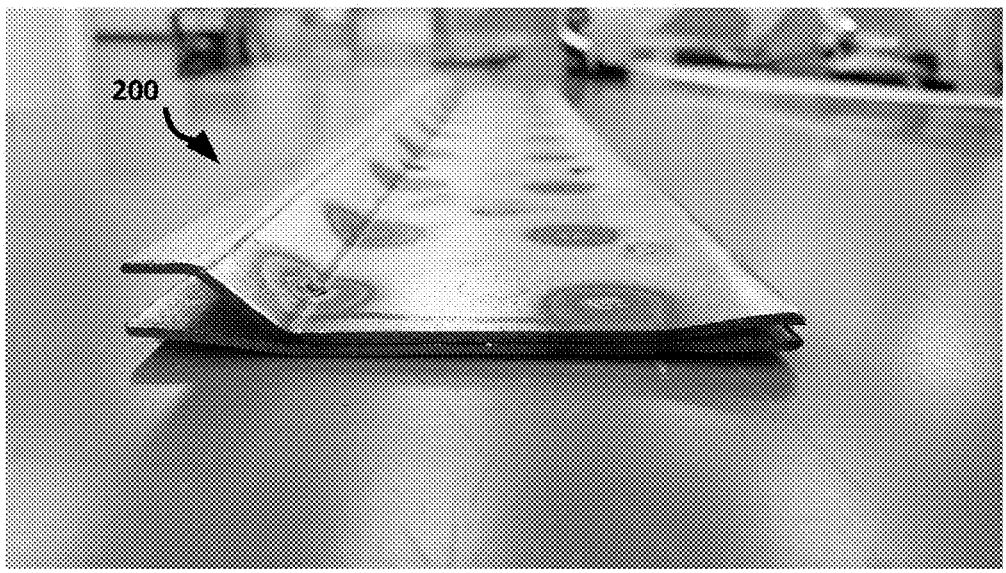

One example of the tool 100 being formed according to this method of assembly is shown in FIG. 2 as a tool 200 with various dimensions shown in inches. As shown in FIG. 2, the holes or apertures 140 are diamond-shaped, although this is not required. Likewise, various photographs of the tool 200 are shown in FIGS. 3A-B.

Figure 4A:
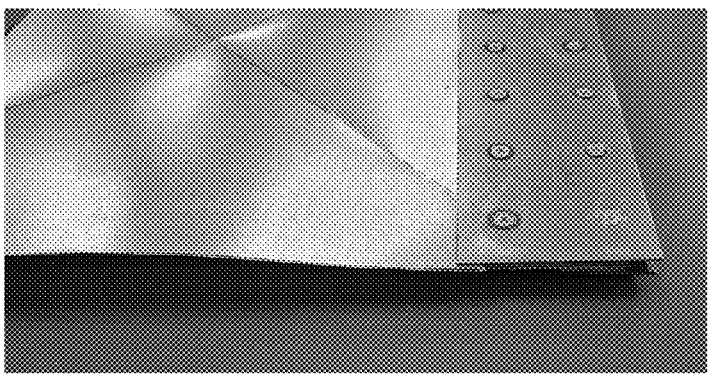
FIGS. 4A-D are photographs showing an embodiment of a technique for using a tool for folding a piece of sheet metal to create a plenum end cap.
Figure 4B:
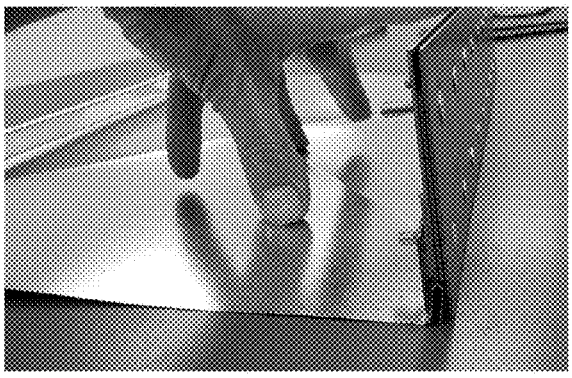

As shown in FIG. 4A, the second pair of jaws 130 may receive (e.g., snugly) an edge portion (e.g., a rectilinear end portion) of a piece of sheet metal between the upper portion 131*a* and the lower portion 131*b*, where the edge portion may contact the body 105 within the second pair of jaws 130, and then enable a formation of a hem at the piece of sheet metal by the user when the user keeps the piece of sheet metal stationary and moving the tool 100 (e.g., rotating in a clockwise or counterclockwise manner) as a lever such that the second pair of jaws 130 bends or folds the edge portion onto what is remaining on the piece of sheet metal to form the hem at the piece of sheet metal via the edge portion, or vice versa. For example, the hem may be J-shaped or U-shaped after the edge portion has been bent or folded. The edge portion within the second pair of jaws 130 may be visible by the user within the holes or apertures 140, which may be before or after such bending or folding.

Figure 4C:
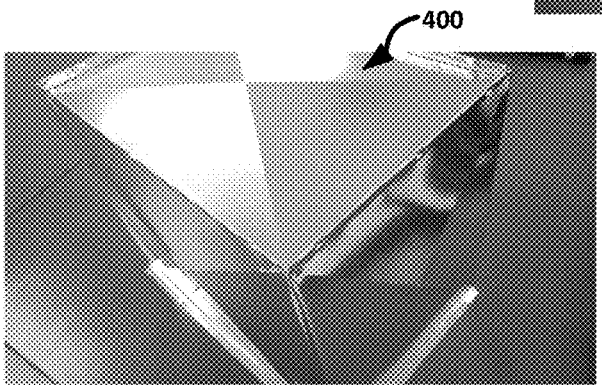
Figure 4D:
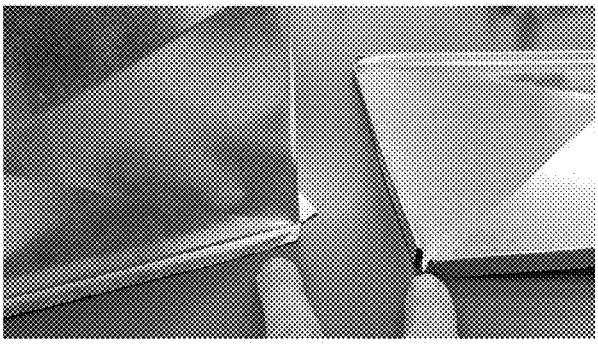

As shown in FIGS. 4A-D, the second pair of jaws 130 can be used to bend or fold the edge portion of the piece of sheet metal to create a plenum end cap for a duct of an HVAC system from the piece of sheet metal. To do this, the edge portion of a square or rectangular (or another suitable shape) piece of sheet metal may be inserted into the second pair of jaws 130, which has the thickness J2T narrower than the thickness J1T of the first pair of jaws 120, and bent or folded using the second pair of jaws 130 (FIG. 4A) by the user when the user keeps the piece of sheet metal stationary and moving the tool 100 (e.g., rotating in a clockwise or counterclockwise manner) as a lever such that the second pair of jaws 130 bends or folds the edge portion onto what is remaining on the piece of sheet metal to form the hem (e.g., primary hem, fold, or bend) at the piece of sheet metal via the edge portion, or vice versa. For example, the hem may be J-shaped or U-shaped after the edge portion has been bent or folded. The edge portion, now being the hem (e.g., J-shape or U-shape), may be removed or withdrawn (e.g., pulled out) from the second pair of jaws 130 and the inserted into the first pair of jaws 120 (e.g., snugly) having the thickness of J1T, which is larger than the thickness of J2T of the second pair of jaws 130, to accommodate the hem in size. Then, the edge portion, now the hem, is bent or folded using the first pair of jaws 120 (FIG. 4B) by the user when the user keeps the piece of sheet metal stationary and moving the tool 100 (e.g., rotating in a clockwise or counterclockwise manner) as a lever such that the first pair of jaws 120 bends or folds the edge portion, now the hem, onto what is remaining on the piece of sheet metal to form the hem folded over twice (e.g., secondary hem, fold, or bend) at the piece of sheet metal, or vice versa. For example, such technique may form an S-shape on the piece of sheet metal via the edge portion. This process can be repeated so that the hem is folded thrice (or more) or on other sides of the piece of sheet metal. For example, when the piece of sheet metal is square or rectangular, then other hems can be formed, as shown in FIGS. 4C and 4D.

Figure 5A:
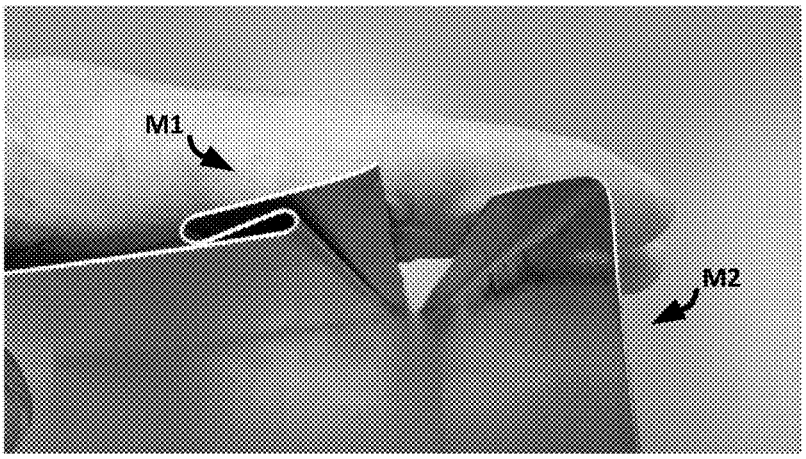
FIGS. 5A-C are photographs showing an embodiment of a technique for using a tool for folding a piece of sheet metal to create a Pittsburgh lock.
Figure 5B:
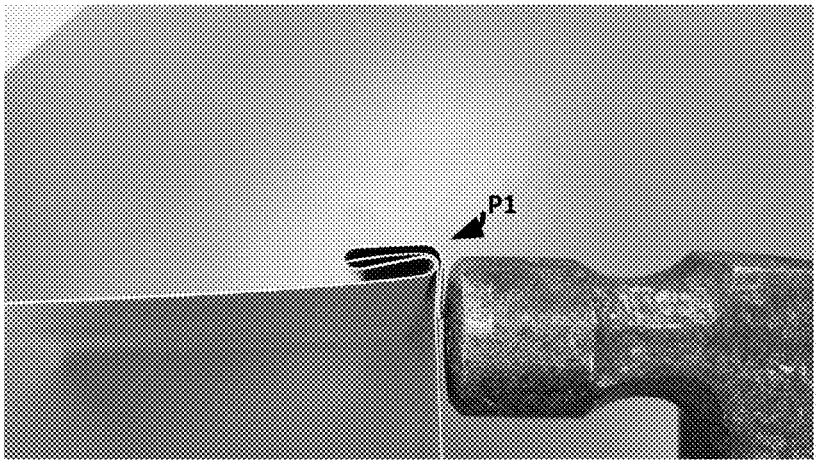
Figure 5C:
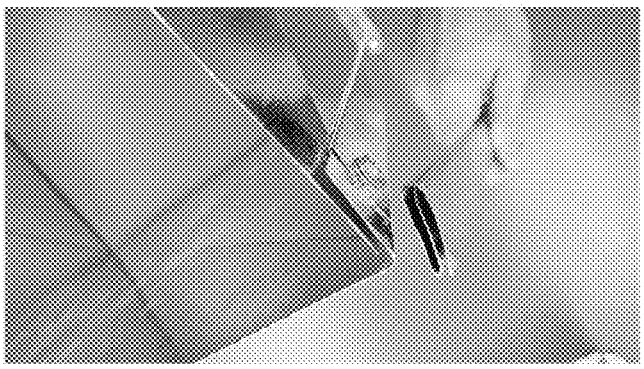

The tool 100 can be used to make certain types of sheet metal locks, such as a Pittsburgh lock, to join two pieces of sheet metal. As shown in FIGS. 5A-B, by using the second pair of jaws 130 to receive the edge portion of the piece of sheet metal to form the hem and then the first pair of jaws 130 to bend the hem, as explained above, the tool 100 can be used to create complementary bends in two pieces of sheet metal M1, M2, and the two pieces of metal can be locked together to create a Pittsburgh lock P1. By using the tool 100, the user may minimize or eliminate a need for using an S-Cleat or an S-Lock to build a box (FIG. 5C). While using the S-Lock may be common in certain use cases, these locks are expensive and may not be available infield or onsite. Therefore, certain bending and coupling techniques (e.g., to form Pittsburgh locks) may be formed infield or onsite with the tool 100 as a substitute or a replacement for the S-lock. Additionally, the tool 100 may be used to make an end cap for a duct of an HVAC system, where the end cap may have bent hems, as explained above.

Figure 6:
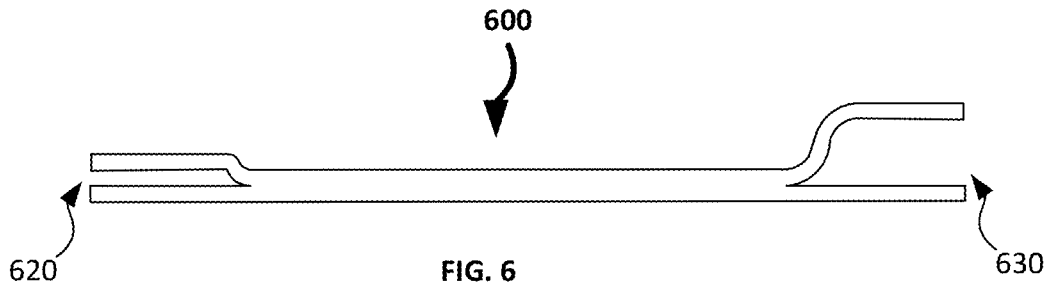
FIGS. 6-7 are schematic cross-sectional views of two embodiments of a tool for folding a piece of sheet metal.

Variations of the tool 100 are possible. For example, FIG. 6 illustrates the tool 100 embodied as a tool 600 that includes the first and second pairs of jaws 620, 630, similar to the first and second pairs of jaws 120,130. However, one difference between these embodiments is that that the lower plate (or the lower portion 121*b* and the lower portion 131*b*) of the pairs of jaws 620, 630 is generally straight or rectilinear, and the upper plate (or the upper portion 121*a* and the upper portion 131*a*) is a sole portion that is structured or angled to enable the first and second pairs of jaws 620, 630 of different thicknesses (J1T is lesser than J2T). Such embodiments can be formed from two separate plates coupled or welded together, as explained above, or be one unitarily (e.g., monolithically) formed component, as explained above. For example, the lower plate (or the lower portion 121*b* and the lower portion 131*b*) of the pairs of jaws 620, 630 is generally straight or rectilinear may be helpful when the tool 600 should rest on a flat surface (e.g., a table, a step) or when packaging the tool 600 for shipping or stacking (e.g., back-to-back).

Figure 7:
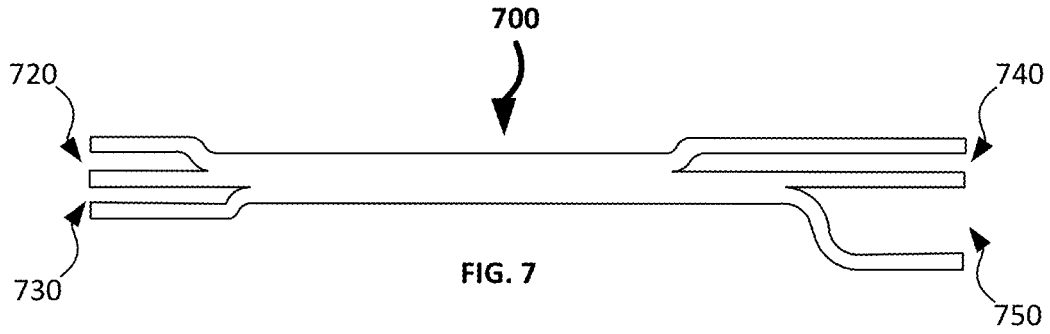

In FIG. 7, yet another embodiment of the tool 100 is shown as a tool 700, where the tool 700 includes multiple pairs of jaws 720, 730, 740, 750, two pairs on each end of the tool 700. In this example, the pairs of jaws 720, 730, 740, 750 may be formed of various widths and thicknesses, whether identical or non-identical to each other. In one example, the pair of jaws 720 is ⅜" in width and 1/16" in thickness, the pair of jaws 730 is ½" in width and 1/16" in thickness, the pair of jaws 740 is 1" in width and 1/16" in thickness, and the pair of jaws 750 is ½" in width and ¼" in thickness.

Note that the pairs of jaws 720, 730 share a portion (cantileveredly extending from the body 105), whether upper or lower, depending on that respective jaw, with opposite surface of that respective jaw functioning for that respective jaw. For example, an upper surface of the lower portion of the pair of jaws 720 is used for the pair of jaws 720, whereas the lower surface of the lower portion of the pair of jaws 730 is used for the pair of jaws 730. Similar applies to the pairs of jaws 740, 750. Likewise, note that such portions may or may not have an identical longitudinal length measured from the body 105. Similarly, note that the pairs of jaws 720, 730 may be identical to each other in thickness, although this is not required, whereas the pairs of jaws 740, 750 may not be identical to each other in thickness, although this is not required.

The user may be supplied (or provided or sent by mail or courier in a package or not in a package) the tool 100 (or its variations or its components) and then instructed on its manufacture or use. For example, such form of instruction may include a printed manual, a presentation, a PDF file, a wizard, a webpage, a mobile app, a video content, an audio content, an augmented reality (AR) content, an or another suitable instructional form factor.

Although various embodiments have been depicted and described in detail herein, skilled artisans know that various modifications, additions, substitutions and the like can be made without departing from this disclosure. As such, these modifications, additions, substitutions and the like are considered to be within this disclosure

What is claimed is:

1. A device comprising:

a first pair of jaws spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa;

a second pair of jaws spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the first pair of jaws and the second pair of jaws are open in opposing directions, wherein the second pair of jaws is U-shaped; and a body spanning between the first pair of jaws and the second pair of jaws.

2. The device of claim 1, wherein the second pair of jaws is configured to bend the piece of sheet metal containing the hem such that the piece of sheet metal containing the hem includes a portion that is S-shaped when the second pair of jaws is moved relative to the piece of sheet metal or vice versa.

3. The device of claim 1, further comprising:

a first plate portion; and a second plate portion, wherein the first pair of jaws, the second pair of jaws, and the body are defined by the first plate portion and the second plate portion as the first plate portion and the second plate portion are assembled with each other between the first pair of jaws and the second pair of jaws.

4. The device of claim 1, wherein at least two of the first pair of jaws, the second pair of jaws, and the body are monolithic with each other.

5. The device of claim 4, wherein the first pair of jaws, the second pair of jaws, and the body are monolithic with each other.

6. The device of claim 1, wherein at least one of the first pair of jaws or the second pair of jaws includes a first portion and a second portion that are spaced apart from each other to respectively form the first distance or the second distance, wherein the first portion or the second portion rectilinearly extends from the body.

7. The device of claim 1, wherein at least one jaw of the first pair of jaws or the second pair of jaws at least partially defines an aperture to provide a visual access into that respective jaw.

8. The device of claim 1, wherein the body includes an aperture between the first pair of jaws and the second pair of jaws.

9. The device of claim 1, wherein the first pair of jaws is U-shaped.

10. The device of claim 1, wherein the first pair of jaws and the second pair of jaws have an identical width.

11. The device of claim 1, wherein the first pair of jaws and the second pair of jaws do not have an identical width.

12. The device of claim 1, further comprising:

a third pair of jaws extending over the first pair of jaws.

13. The device of claim 12, wherein the third pair of jaws is spaced apart from each other at a third distance such that the edge portion of the piece of sheet metal is receivable therebetween and the third pair of jaws is configured to form the hem on the piece of sheet metal via the edge portion being bent when the third pair of jaws is moved relative to the piece of sheet metal or vice versa.

14. The device of claim 13, wherein the third pair of jaws and the first pair of jaws shares a portion extending from the body.

15. The device of claim 14, wherein the third pair of jaws form a longer mouth than the first pair of jaws as measured from the body.

16. The device of claim 1, further comprising:

a third pair of jaws extending over the second pair of jaws.

17. The device of claim 16, wherein the third pair of jaws is spaced apart from each other at a third distance such that the edge portion of the piece of sheet metal is receivable therebetween and the third pair of jaws is configured to form the hem on the piece of sheet metal via the edge portion being bent when the third pair of jaws is moved relative to the piece of sheet metal or vice versa.

18. The device of claim 17, wherein the third pair of jaws and the second pair of jaws shares a portion extending from the body.

19. The device of claim 18, wherein the third pair of jaws form a longer mouth than the second pair of jaws as measured from the body.

20. The device of claim 1, wherein the body has a side that is flat or planar and spans between the first pair of jaws and the second pair of jaws.

21. A method comprising:

causing a user to access a tool including a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws;

causing the user insert the edge portion into the first pair of jaws to form the hem on the piece of sheet metal via the edge portion being bent as the first pair of jaws is moved relative to the piece of sheet metal or vice versa; and causing the user to insert the hem into the second pair of jaws to bend the piece of sheet metal containing the hem as the second pair of jaws is moved relative to the piece of sheet metal or vice versa.

22. A method comprising:

supplying a tool to a user, wherein the tool includes a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws; and instructing the user to:

insert the edge portion into the first pair of jaws to form the hem on the piece of sheet metal via the edge portion being bent as the first pair of jaws is moved relative to the piece of sheet metal or vice versa; and insert the hem into the second pair of jaws to bend the piece of sheet metal containing the hem as the second pair of jaws is moved relative to the piece of sheet metal or vice versa.

23. A method comprising:

manufacturing a tool including a first pair of jaws, a second pair of jaws, and a body, wherein the first pair of jaws is spaced apart from each other at a first distance such that an edge portion of a piece of sheet metal is receivable therebetween and the first pair of jaws is configured to form a hem on the piece of sheet metal via the edge portion being bent when the first pair of jaws is moved relative to the piece of sheet metal or vice versa, wherein the second pair of jaws is spaced apart from each other at a second distance greater than the first distance such that the hem is receivable therebetween and the second pair of jaws is configured to bend the piece of sheet metal containing the hem when the second pair of jaws is moved relative to the piece of sheet metal or vice versa, wherein the body spans between the first pair of jaws and the second pair of jaws, wherein the first pair of jaws and the second pair of jaws are open in opposing directions, wherein the second pair of jaws is U-shaped.

24. The method of claim 23, wherein the tool is manufactured by assembling a pair of plates such that the pair of plates is joined to each other between the first pair of jaws and the second pair of jaws while the pair of plates defines the first pair of jaws, the second pair of jaws, and the body.

25. The method of claim 23, wherein the tool is manufactured by forming the body to be monolithic with at least one of the first pair of jaws or the second pair of jaws.

* * * * *